US009222176B2

(12) United States Patent
Tyborski

(10) Patent No.: US 9,222,176 B2
(45) Date of Patent: Dec. 29, 2015

(54) ALKALINE CLEANER FOR CLEANING ALUMINUM SURFACES

(75) Inventor: Thomas Tyborski, Düsseldorf (DE)

(73) Assignee: Ecolab USA Inc., Saint Paul, MN (US)

( * ) Notice: Subject to any disclaimer, the term of this patent is extended or adjusted under 35 U.S.C. 154(b) by 228 days.

(21) Appl. No.: 11/916,159

(22) PCT Filed: Jun. 1, 2005

(86) PCT No.: PCT/EP2005/052513

§ 371 (c)(1), (2), (4) Date: May 8, 2008

(87) PCT Pub. No.: WO2006/128498

PCT Pub. Date: Dec. 7, 2006

(65) Prior Publication Data

US 2008/0234164 A1 Sep. 25, 2008

(51) Int. Cl.

| | |
|---|---|
| ***C11D 3/02*** | (2006.01) |
| ***C23G 1/14*** | (2006.01) |
| ***C23G 1/22*** | (2006.01) |
| ***C11D 3/00*** | (2006.01) |
| ***C11D 3/04*** | (2006.01) |
| ***C11D 3/395*** | (2006.01) |
| ***C11D 11/00*** | (2006.01) |
| ***C23G 1/20*** | (2006.01) |

(52) U.S. Cl.

CPC ..... *C23G 1/22* (2013.01); *C11D 3/0073* (2013.01); *C11D 3/044* (2013.01); *C11D 3/046* (2013.01); *C11D 3/3956* (2013.01); *C11D 11/0029* (2013.01); *C23G 1/20* (2013.01)

(58) Field of Classification Search

CPC ..... C11D 11/0029; C11D 1/72
USPC ..... 510/245, 254, 255, 189, 197
See application file for complete search history.

(56) References Cited

U.S. PATENT DOCUMENTS

| | | | | |
|---|---|---|---|---|
| 4,330,423 | A * | 5/1982 | Smolka et al. | 510/220 |
| 4,755,319 | A * | 7/1988 | Smolka et al. | 510/507 |
| 4,820,440 | A * | 4/1989 | Hemm et al. | 510/228 |
| 5,614,027 | A | 3/1997 | Dunn et al. | |
| 5,750,483 | A * | 5/1998 | Welch et al. | 510/230 |
| 6,077,440 | A * | 6/2000 | Roe et al. | 210/699 |
| 6,686,325 | B2 * | 2/2004 | Hoyt et al. | 510/255 |
| 6,812,194 | B2 | 11/2004 | Ruhr et al. | |
| 6,827,090 | B2 * | 12/2004 | Nurnberger et al. | 134/22.1 |
| 7,204,890 | B2 * | 4/2007 | Held et al. | 134/40 |
| 7,467,633 | B2 * | 12/2008 | Smith et al. | 134/25.2 |
| 7,910,204 | B2 * | 3/2011 | Hartman et al. | 428/343 |
| 2003/0109394 | A1 | 6/2003 | Ruhr et al. | |
| 2003/0176305 | A1 | 9/2003 | Hoyt et al. | |
| 2003/0211962 | A1 * | 11/2003 | Held et al. | 510/475 |
| 2004/0242449 | A1 * | 12/2004 | Joshi et al. | 510/372 |
| 2008/0234164 | A1 * | 9/2008 | Tyborski | 510/254 |

FOREIGN PATENT DOCUMENTS

| | | | |
|---|---|---|---|
| GB | 1320793 | | 6/1973 |
| JP | 2001049475 | A | 2/2001 |
| JP | 2001064700 | | 3/2001 |
| JP | 2001064700 | A | 3/2001 |
| JP | 2003096491 | B2 | 4/2003 |
| JP | 2004123979 | B2 | 4/2004 |
| JP | 2005097726 | B2 | 4/2005 |
| WO | WO96/00316 | | 1/1996 |
| WO | WO 9600316 | * | 1/1996 |
| WO | WO9600316 | A1 | 1/1996 |
| WO | WO96/29451 | | 9/1996 |
| WO | WO 9629451 | * | 9/1996 |
| WO | WO9629451 | A1 | 9/1996 |

OTHER PUBLICATIONS

Daufin G et al. "*Corrosion Inhibition of an Aluminium-Silicon-Magnesium Alloy In Alkaline Media*", *Corrosion Science*, Oxford, GB, vol. 17, No. 11, 1977, pp. 901-902 XP001062604, ISSN: 0010-938X.

* cited by examiner

*Primary Examiner* — Nicole M Buie-Hatcher
*Assistant Examiner* — M. Reza Asdjodi
(74) *Attorney, Agent, or Firm* — Merchant & Gould P.C.

(57) ABSTRACT

Composition for cleaning surfaces which are susceptible to corrosion in alkaline liquids, comprising at least one alkalinity source, at least one inorganic salt containing at least one cation selected from the elements of the second or third main group of the periodic table of the elements, and whereby the composition is free of any triazole and/or any alkali metal borate, aqueous concentrate comprising the composition, use solutions comprising the composition or the aqueous concentrate and method of cleaning surfaces which are susceptible to corrosion in alkaline liquids using the above aqueous concentrate or any of the above use solutions.

15 Claims, No Drawings

ALKALINE CLEANER FOR CLEANING ALUMINUM SURFACES

CROSS REFERENCE TO RELATED APPLICATIONS

This application is a National Stage Entry of International Application No. PCT/EP2005/052513, filed Jun. 1, 2005, which application is incorporated herein by reference in its entirety.

The present invention refers to a composition for cleaning surfaces which are susceptible to corrosion in alkaline liquids, to an aqueous concentrate comprising the composition, use solutions comprising this composition or said aqueous concentrate and to a method for cleaning such surfaces.

Articles completely or in part made of various kinds of metal and in particular ones having surfaces completely or in part made of metal play an important part in our daily life. Generally, we get into contact with such articles several times a day, in the domestic area, for example in the household or in form of window frames, furniture, living accessories like lamps, in our free time for example with sports equipment or in connection with all kinds of means for moving such as bicycles, motorcycles, boats and cars, but also in the industrial field as parts of all kinds of machines like manufacturing or processing machines, cleaning machines and others, in the form of or as a part of construction materials like carriers, in all kinds of vehicles, in very specialized areas for example in medical instruments and a lot more.

However, independent from where or for which purpose those articles are used they have to be cleaned some time, since they generally are not used in one-way articles but in articles with a comparatively long duration of life. Moreover, the kind of soil which has to be removed from the surfaces of such articles may be very different. It may comprise all kinds of natural or synthetic fats, greases or oils, proteins, pigments and other types of organic and also inorganic deposits.

Unfortunately, lots of objects comprising at least parts made of metal are susceptible to corrosion when getting into contact with alkaline liquids, for example in order to be cleaned, and in particular when getting into contact with highly alkaline liquids which have excellent cleaning properties. This tendency of corrosion in alkaline liquids especially applies to soft metals like aluminum, zinc, tin, lead and cadmium but also to their alloys and to galvanized steel such as zinc plated steel.

In the past this problem was avoided on one hand by using organic wash solvents to clean such surfaces which are susceptible to corrosion in alkaline liquids. Typical solvents contained hydrocarbon or halogenated hydrocarbon solvents. However, those solvents are very often no longer desirable as the non-halogenated hydrocarbons usually employed generally are flammable, have high volatility and dubious ability to be recycled for continuous use whereas the halogenated hydrocarbons often are toxic, have a negative impact on the environment and are comparatively expensive with respect to their waste disposal.

Therefore, there were lots of attempts in the past to find substances which can function as corrosion inhibitors but do not negatively influence the cleaning performance or stability of alkaline cleaning compositions. Even since the mid-20$^{th}$ century it has been known to use silicates like alkali metal silicates as corrosion inhibitors. Those compounds are still in use as they are comparatively effective, in particular for surfaces formed of aluminum, aluminum alloys and zinc plated steel.

U.S. Pat. No. 5,862,345, for examples, describes a method for removing organic deposits from articles such as those used in the food processing industry. According to this method a cleaning solution comprising at least a peroxygen compound, a metasilicate, a chelate and a builder is applied to the surface. Cleaning with this solution in some cases may proceed even at low temperatures of below 40° C.

However, the use of such silicate compositions for cleaning the above mentioned metal surfaces has the disadvantage that residues of the composition on the metal surface, for example due to insufficient rinsing, cause tenacious silicate layers thereon. Such silicate layers are undesirable because of optical as well as hygienic reasons. However, the removal of those silicate layers generally is very difficult and may require the application of chemicals which are highly toxic and difficult to handle such as hydrogen fluoride solutions. Corresponding silicate layers may also occur in case said solutions are applied on warm surfaces which dry the cleaning solution very quickly, or in case the cleaning solutions are used to clean surfaces which are difficult to reach, for example interior surfaces of a machine, and which, therefore, are not completely rinsed after the cleaning step.

GB 541,803 mentions that depending on the choice of the silicate used and its concentration in the cleaning solution, in particular an aluminum or tin surface may be spangled or attacked by the cleaning solution despite the presence of silicates. According to this document said problem is overcome by further adding a soluble inorganic mercury salt. However, independent from the disadvantage to use mercury compounds in said cleaning solution it still contains silicates which may form the tenacious surface layers as mentioned above.

In order to completely avoid the use of silicate substances U.S. Pat. No. 5,736,495 discloses a metal cleaner composition comprising besides an alkaline metal salt and a surfactant a combination of a triazole compound and an alkali metal borate as anticorrosion agent. The application of such a metal cleaning composition is exemplified with respect to steel and brass surfaces.

The latter document mentions that there are various other corrosion inhibitors known including inorganic compounds such as alkali metal phosphates, borates, molybdates, arsenates, arsenites, nitrates, nitrites and chromites as well as various organic compounds such as mercaptobenzothiazole, benzotriazole, piperazine, ethylene diamine tetraacetic acid and the reaction product of phosphoric acid or boric acid and an alkanolamine. However, there still is a need to provide further corrosion inhibitors since as mentioned in this document there has not been provided an inhibitor or a combination of inhibitors for all metals or metal alloys, in particular for soft metals.

Organic and organometallic compounds also have been used as corrosion inhibitors for quite some time. Derivatives of pyridine, diethyl thiourea, toluidine or mixtures thereof represent examples for such corrosion inhibitors usually employed. Furthermore, tributyl tin and tributyl tin naphthanates have been used for ship paints and sulfonates, phenolates and salicylates of barium, calcium or magnesium were added to oil additives. However, such compounds are no longer desirable nowadays because of environmental reasons and because of their toxicity.

Moreover, when developing compositions for the cleaning of the above described metal surfaces it has to be taken into account that besides outer surfaces which typically are comparatively easy to reach, there is also a need to clean inner surfaces which often are difficult to reach. In particular in case inner surfaces are concerned the cleaning has to take place without the requirement for an additional mechanical treatment of the surface.

The problem underlying the present invention, therefore, is to provide an alkaline cleaning composition which is suitable for the cleaning of metals which are susceptible to corrosion in an alkaline liquid, and in particular for the cleaning of soft metals like aluminum or its alloys or for galvanized steel, like zinc plated steel, and which also allows a cleaning of inner surfaces which are difficult to reach without the requirement of an additional mechanical treatment.

The above problem is solved by a composition for cleaning surfaces which are susceptible to corrosion in alkaline liquids, comprising at least one alkalinity source and at least one inorganic salt containing at least one cation selected from the elements of the second or third main group of the periodic table of the elements, and whereby the composition is free of any triazole and/or any alkali metal borate.

The above composition preferably is applied to the surfaces to be cleaned in the form of its aqueous solution. Although the aqueous solution of the above composition can also be applied on surfaces made of other metals it is particularly preferred to use the cleaning composition of the present invention for cleaning surfaces made of soft metals like aluminum, zinc, tin, lead, cadmium, their alloys or metals plated with any of those metals like zinc plated steel. It is more preferred to use the composition for cleaning surfaces made of aluminum, aluminum alloys or zinc plated steel.

The at least one inorganic salt contains at least one cation selected from the elements of the second or the third main group of the periodic table of the elements. The corresponding elements should have at least partly metallic properties. This means that aluminum cations and germanium ions represent suitable cations in the present invention whereas it is not preferred to use compounds containing boron cations. Although gallium, indium and thallium cations generally may also be used in the salts according to the present invention it is preferred that the cation is selected from the group consisting of $Mg^{2+}$, $Ca^{2+}$, $Sr^{+}$, $Ba^{2+}$, $Al^{3+}$ or mixtures thereof. $Ca^{2+}$ represents the most preferred cation.

In a preferred embodiment the anions forming the counterions to the above cations in the salt according to the present invention are selected from the group comprising halides, in particular chloride, bromide or iodide, sulfate and carbonate. It is also possible to use double salts i.e. salts formed of two or more different salts which have a simple stoichiometric ratio and which crystallize together. The corresponding anions in such double salts may be the same like in $CaMg(CO_3)_2$ or different like in apatite ($Ca_5(PO_4)_3F$). However, it is preferred not to use double salts.

Although oxides of the above mentioned elements of the second or third main group of the periodic table of the elements can also be contained in the composition of the present invention, in particular oxides like MgO, CaO or $Al_2O_3$ are not contained therein.

In general appropriate salts for the composition according to the present invention are not limited to readily soluble salts. It is also possible to use poorly soluble salts like calcium carbonate, magnesium carbonate or calcium sulfate. Nonetheless salts are preferred in the composition according to the invention which are readily soluble and which show a reduced risk for precipitation during the cleaning process.

In a particularly advantageous embodiment the one or more salts are contained in the composition in a total amount of from 0.01 to 20 wt. %, preferably of from 0.05 to 15 wt. % and more preferred of from 0.1 to 3.5 wt. % based on the total composition.

Suitable alkalinity sources for use in the composition of the present invention are those alkaline metal salts which are capable of providing an alkalinity in aqueous solutions which allows the removal of the soil typically deposited on metal surfaces. Depending on the employment of the article comprising at least one of the surfaces to be cleaned or a part thereof various kinds of soils may be deposited thereon. Such soils are exemplified by all types of natural or synthetic fats, greases, waxes or oils, proteins, carbohydrates, baked-on carbons and charred organics such as are formed in food processing machines or in the household, pigments and dyes, minerals, excretions of humans and animals and other types of organic and also inorganic deposits and mixtures thereof. The alkalinity of the composition according to the present invention should be high enough that aqueous solutions thereof are able to remove the main part of the respective soiling.

Suitable alkalinity sources for use in the composition of the present invention are exemplified by sodium hydroxide, potassium hydroxide, potassium and sodium carbonates and their hydrates, sodium and potassium bicarbonates, alkaline metal ortho or complex phosphates such as trisodium orthophosphate, tripotassium orthophosphate, sodium or potassium pyrophosphate, tripolyphosphates and hexametaphosphates, alkaline metal acetates, citrates, tartrates, succinates, phosphonates, alkaline earth hydroxides such as calcium hydroxide or barium hydroxides, or mixtures thereof. However, it is preferred to use sodium hydroxide, potassium hydroxide or mixtures thereof. Preferably, those compounds are used in their solid form.

In most cases, in particular if sodium or potassium hydroxide function as alkalinity sources, it will be sufficient if the alkaline source is contained in the composition in a total amount of from 1 to 40 wt. %, preferably of from 2 to 30 wt. % and more preferred of from 5 to 25 wt. % based on the total composition.

In order to obtain an acceptable or even excellent cleaning performance the aqueous solution obtained from the composition should have a pH value (1%, 20° C., demineralized water) in the range of from 9 to 13, preferably of from 10 to 12, more preferred above 11.

The cleaning of metal surfaces, in particular of aluminum, aluminum alloys or zinc plated steel with an aqueous solution exhibiting a high pH value obtained from such a composition typically leads to corrosion effects and finally to a decomposition of the metal surface. However, surprisingly it has been found out that in the presence of the above mentioned salts containing one or more cations selected from the elements of the second or third main group of the periodic table of the elements such corrosion effects and decompositions of the metal surface were not observed. It is therefore assumed that those inorganic salts function as corrosion inhibitors for the foregoing metal surfaces in aqueous alkaline compositions.

Moreover, it has been exceptionally amazing that when using the above mentioned inorganic salts in aqueous solutions of the composition according to the present invention it is no longer required to use alkali metal silicates or any other compound based on silicon. Therefore, the composition according the present invention preferably is free of any compound containing silicon or elementary silicon.

In addition because of the presence of the above specified inorganic salts, it is also not required to use one or more organometallic compounds as corrosion inhibitors in alkaline solutions intended for the cleaning of metal surfaces which are sensitive to corrosion under such conditions. Consequently, in a preferred embodiment the composition according to the present invention is free of any organometallic compound. Herein, "organometallic compounds" are meant to refer to elementorganic compounds having a direct metal-carbon bond. Metal salts of organic acids, alcoholates, crown compounds and other inclusion compounds as well as chelates and metal acetylacetonates are not considered to be organometallic compounds whereas silicones, organophosphorus compounds, organoarsenic compounds and organoboron compounds represent organometallic compounds in the sense of the present invention.

The composition of the present invention may also comprise other components typically used in alkaline cleaning compositions like sequestrants, surfactants, disinfectants, bleaching agents, oxidants, builders, solubilizers, solvents or mixtures thereof. Some of those compounds may also have several functions. For example oxidizing agents like hypochlorite which generate active chlorine also exhibit disinfecting properties besides their cleaning booster properties. In such cases the total amount of a specific substance which may be contained in the composition according to the invention can represent the sum resulting from the addition of the amounts of the single components corresponding to its different properties. For example, if the amount of oxidant in the composition is intended to not exceed 40 wt. % based on the total composition, the amount of hypochlorite may nevertheless be greater than 40 wt. % if in addition to the oxidant a further disinfecting agent may be present.

It is preferred that the composition according to the present invention contains one or more oxidants. Suitable oxidants may be represented by one or more compounds generating active chlorine like hypochlorites exemplified by chloride of lime, calcium hypochlorite, sodium hypochlorite and potassium hypochlorite. However, peroxygen compounds such as perborates or percarbonates preferably completed with a metal like sodium, lithium, calcium or potassium, or hydrogen peroxide may be suitable as oxidants as well. However, preferably the present composition is free of any alkali metal perborate. In a particularly preferred embodiment the present composition contains sodium hypochlorite, potassium hypochlorite or mixtures thereof and no other bleaching or oxidizing agent.

The one or more oxidants should be contained in the composition according to the present invention in a total amount of from 30 to 80 wt. %, preferably of from 35 to 70 wt. % and more preferred of from 40 to 65 wt. % based on the total composition.

Surprisingly, the cations used in the aqueous solution of the composition according to the invention do not cause any decomposition of the hypochlorites which may also be present in the composition. However, the stability of the aqueous solution formed of the composition and the solubility of the above mentioned salts in said alkaline solution can be improved by further adding one or more sequestrants to the composition. This applies in particular to calcium and magnesium as cations since those cations form water insoluble hydroxides in alkaline solutions. Appropriate sequestering agents can be exemplified by ethylene diaminetetraacetic acid, nitrilo triacetic acid, phosphates in particular polyphosphates such as pentasodium triphosphate, polyhydroxycarboxylic acids, citrates, in particular alkali citrates, dimercaprol, triethanol amine, crown compounds or phosphonoalkane polycarboxylic acids. Under the alkaline conditions in the aqueous solution the above mentioned acids usually will be present in the form of their salts, preferably in the form of their sodium or potassium salts. However, when producing the composition according to the invention the acids as well as the corresponding salts may be used.

The phosphonoalkane polycarboxylic acids preferably comprise a straight chain hydrocarbon backbone having 3 to 6 carbon atoms and 2 to 5 carboxylic acid moieties. An especially preferred phosphonoalkane polycarboxylic acid represents 2-phosphonobutane-1,2,4-tricarboxylic acid. Those compounds are particularly advantageous in combination with an calcium or magnesium containing corrosion inhibitor salt.

The one or more sequestering agents should be contained in the composition in a total amount of from 2 to 35 wt. %, preferably of from 5 to 25 wt. % and more preferred of from 9 to 20 wt. % based on the total composition in order to obtain a sufficient sequestering performance.

An improved cleaning performance of the aqueous solution formed from the composition according to the present invention in some cases may be achieved if one or more surfactants are additionally added to the composition. However, in case surfactants are used it has to be guaranteed that they are functioning under the highly alkaline conditions of the solutions obtained from the composition. Although all kinds of surfactants, i.e. anionic, cationic, non-ionic and amphiprotic, may be applied especially appropriate surfactants for use in the present invention represent anionic and/or non-ionic surfactants.

Suitable anionic surfactants are exemplified by alkyl arene sulfonates, in particular alkyl benzene sulfonates and alkyl naphthalene sulfonates, alkylsulfonates, preferably comprising 12 to 18 carbon atoms in the alkyl moiety, α-olefin sulfonates preferably containing 12 to 17 carbon atoms in the olefin moiety, or alkyl sulfates preferably having 11 to 17 carbon atoms in the alkyl moiety, or mixtures thereof. Usually, said compounds are used in the form of their alkali salts, in particular in the form of their sodium salts. An especially advantageous anionic surfactant represents sodium lauryl sulfate. Anionic surfactants may improve the cleaning performance but also the stability of the composition.

Although other known non-ionic surfactants like alkoxylated, in particular ethoxylated and/or propoxylated, fatty alcohols or fatty amines, which also may be alkyl-terminated, for example butyl-terminated, are suitable in the composition according to the present invention as well it is preferred to use aminoxides which correspond to the formula

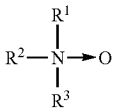

wherein $R^1$ to $R^3$ independently represent an aliphatic or cyclic hydrocarbon residue have 1 to 20 carbon atoms and wherein at least one and preferably only one of $R^1$ to $R^3$ has a hydrocarbon residue with at least 11 carbon atoms. It is also possible to use a mixture of several aminoxides. Preferred aminoxides represent coconut alkyl dimethylamine oxide or lauryl dimethylamine oxide.

Further non-ionic surfactants which may be used in the present composition represent alkyl polyglucosides. The alkyl group of alkyl polyglucosides generally is derived from native fats or oils or petrochemically produced alcohols. The sugar moiety typically is derived from reducing sugars having 5 or 6 carbon atoms.

Cationic surfactants for use in the composition according to the present composition can be exemplified by quaternary ammonium salts. They preferably represent saturated or unsaturated compounds which are derived from esterifying trialkanol amine, in particular triethanol amine, with fatty acids and subsequent quaternization with appropriate alkylation agents. Suitable fatty acids have 12 to 18 carbon atoms, such as lauric acid, myristic acid, palmitic acid, oleic acid or stearic acid. It is particularly preferred to use mixtures of fatty acids as obtained in technical processes like the acid mixtures derived from coconut oil, palm kernel oil, rapeseed oil or tallow oil.

In a particularly preferred embodiment the one or more surfactants are contained in the composition in a total amount of from 1 to 30 wt. %, preferably of from 2 to 20 wt. % and more preferred of from 4 to 15 wt. % based on the total composition.

Taking the above description into account depending on the kind of soil and the form and location of the metal surface to be cleaned it may be either possible to use a foaming cleaner or a non-foaming cleaner wherein the non-foaming may be achieved by completely omitting any kind of surfactant or by using low-foaming surfactants.

In order to obtain a homogenous solution from the above composition it may be helpful to further add one or more solubilizers. In particular they facilitate the dispersion of organic components such as the one or more surfactants in the aqueous solution. Suitable solubilizers are exemplified by sodium, potassium, ammonium and alkanol ammonium salts of sulfonates of xylene, toluene, ethylbenzoate, isopropylbenzene, naphthalene or alkyl naphthalene, phosphate esters of alkoxylated alkyl phenols, phosphate esters of alkoxylated alcohols and sodium, potassium and ammonium salts of alkyl sarcosinates, as well as mixtures thereof.

In a preferred embodiment the one or more solubilizers are contained in the composition in a total amount of from 1 to 35 wt. %, preferably of from 5 to 25 wt. % and more preferred of from 9 to 20 wt. %.

The composition according to the present invention may additionally contain one or more other compounds commonly used in cleaning compositions like ones selected from the group comprising disinfectants, builder substances, solvents and bleaching agents. Those compounds preferably are contained in the composition according to the invention in a total amount of from 0 to 20 wt. %, preferably of from 2 to 15 wt. %, more preferred below 10 wt. %.

Typically, the compounds exemplified above in connection with the oxidants also function as bleaching agents. However, this does not exclude to use compounds as bleaching agents which are not mentioned above.

Suitable builders are exemplified by sodium carbonate, sodium sesquicarbonate, sodium sulfate, sodium hydrogencarbonate, phosphates like pentasodium triphosphate, nitrilo triacetic acid or its salt, respectively, citric acid or its salt, respectively, mixtures thereof.

Appropriate disinfectants beside the ones mentioned above in connection with oxidants for use in the composition according to the present invention represent aldehydes such as formaldehyde, glyoxal or glutaraldehyde, phenol derivatives and alcohols or mixtures thereof.

In a preferred embodiment the composition according to the present invention is present in the form of a powder or a solid block. The production of said cleaning powders or solid blocks proceeds according to the procedures mentioned in the state of the art. For example, the powders may be obtained by producing an aqueous slurry of the above composition which is sprayed through nozzles at the upper end of the drying tower under high pressure to form hollow sphere powder.

The composition may be formed into a solid block by at first melting the alkaline source which preferably is placed within a cartridge, and adding the other components of the composition to the melt. It is preferred to add the other components sequentially starting with the anionic surfactant and the non-ionic surfactant, followed by the sequestrant(s), the oxidant(s), the solubilizer(s) and afterwards the remaining components, as far as included.

As mentioned above the composition according to the present invention is applied to the solution to be cleaned in the form of its aqueous solution. Said aqueous solution may be formed directly before use or it may be formed beforehand. In case the solution is formed directly before use preferably the composition in the form of the powder or the solid block as specified above will be dispensed in the required amount and then dissolved in the required amount of water to obtain a use solution with a predetermined concentration. However, in case the composition is used in the form of a solid block it is also possible to obtain the use solution by rinsing the solid block with a defined amount of water to obtain the use solution in a predetermined concentration.

Moreover, the aqueous cleaning solution may also be formed not directly before use and then stored until it is needed. Therefore, a further object of the present invention represents an aqueous concentrate which comprises the above specified composition and free water. With free water is meant pure water. Besides the pure water added to dissolve the single components of the composition additional water may be contained in case one or more compounds are not used in the form of solids but in the form of their aqueous solutions. For example the alkaline source or the surfactants may be employed dissolved in water when producing the aqueous solution according to the invention. However, in case the composition is present in the form of a powder or a solid block preferably the single components are not used in the form of their aqueous solutions whereas to prepare the aqueous solution according to the invention the use of those compounds as aqueous solution may facilitate the production of the aqueous cleaning concentrate.

Preferably the water is demineralized and contained in the concentrate in an amount of from 30 to 90 wt. %, more preferred of from 35 to 88 wt. % and most preferred of from 40 to 85 wt. %.

The above mentioned aqueous concentrate preferably contains the above cleaning composition in an amount of from 30 to 95 wt. %, preferably of from 35 to 90 wt. % and more preferred of from 40 to 85 wt. % based on the total aqueous concentrate.

Moreover, the aqueous concentrate according to the invention contains the one or more salts in a total amount of from 0.01 to 10 wt. %, preferably of from 0.05 to 5 wt. % and more preferred of from 0.1 to 3.5 wt. % based on the total concentrate.

In a preferred embodiment the alkaline source is contained in the aqueous concentrate in a total amount of from 1.5 to 20 wt. %, preferably of from 2 to 10 wt. % and more preferred of from 3 to 5 wt. % based on the total concentrate. It is particularly preferred that the concentrate has a pH value (1%, 20° C.) in the range of from 9 to 13, preferably of from 10 to 12, more preferred above 11.

In addition the one or more sequestrants are contained in the aqueous concentrate in a total amount of from 1 to 10 wt. %, preferably of from 2 to 8 wt. % and more preferred of from 3 to 5 wt. % based on the total concentrate.

The aqueous concentrate according to the present invention preferably contains the one or more surfactants in a total amount of from 1 to 15 wt. %, preferably of from 2 to 10 wt. % and more preferred of from 2.3 to 6 wt. % based on the total concentrate.

Moreover, the one or more oxidants are contained in the concentrate in a total amount of from 10 to 40 wt. %, preferably of from 15 to 30 wt. % and more preferred of from 20 to 28 wt. % based on the total concentrate. As percarbonates and perborates are not stable in alkaline solutions the aqueous concentrate preferably does not contain any of those compounds.

The aqueous concentrate additionally may contain one or more solvents selected from monohydric or polyhydric alcohols or glycol ether, in particular from ethanol, n-propanol or i-propanol, butanol, glycol, propanediol, butanediol, glycerol, diglycol, propyldiglycol, butyldiglycol, ethylene glycol monomethyl ether, ethylene glycol monoethyl ether, ethylene glycol monopropyl ether, ethylene glycol mono-n-butyl ether, diethylene glycol monomethyl ether, diethylene glycol monoethyl ether, propylene glycol monomethyl ether, propylene glycol monoethyl ether or propylene glycol monopropyl ether, dipropylene glycol monomethyl ether, dipropylene glycol monoethyl ether, methoxy triglycol, ethoxy triglycol, butoxy triglycol, 1-butoxyethoxy-2-propanol, 3-methyl-3-methoxy butanol, propylene glycol mono-t-butyl ether and mixtures thereof.

In order to obtain optimized cleaning results the aqueous cleaning concentrate according to the invention should represent a homogenous solution. Therefore, it is preferred to produce the concentrate according to the invention by dissolving the corrosion inhibitor salt in water first and add the other components thereto afterwards. Although the sequence of their addition is not particularly limited it is advantageous to add the one or more alkalinity sources first, followed by the addition of the anionic surfactant, the non-ionic surfactant, the sequestrant, the oxidant, the solubilizers and afterwards the remaining components, as far as included. It is also possible to not dissolve the corrosion inhibitor salt at first but to add it at the end of producing the concentrate. In case the corrosion inhibitor salt is poorly soluble it can be dissolved for example in an acid first, neutralized and then mixed with the other ingredients.

The above described aqueous concentrate may be used as such for cleaning the above specified metal surfaces or it may be further diluted, preferably with water or with any of the solvents mentioned above or a mixture thereof. In a preferred embodiment the concentrate is diluted with water to result in an aqueous use solution comprising the concentrate according to the invention in an amount of from 0.1 to 10 wt. %, preferably of from 0.5 to 8 wt. %, more preferred of from 1 to 5 wt. % based on the total use solution.

Therefore, a further object of the present invention is an aqueous use solution for cleaning surfaces which are susceptible to corrosion in alkaline liquids, comprising the aqueous concentrate according to the present invention in an amount of from 0.1 to 10 wt. %, preferably of from 0.5 to 8 wt. %, more preferred of from 1 to 5 wt. % based on the total use solution.

As mentioned above a use solution may also be obtained directly from the cleaning composition as such or in the form of a powder or a solid block. Therefore, a further object of the present invention relates to an aqueous use solution for cleaning surfaces which are susceptible to corrosion in alkaline liquids comprising the above defined composition, including in a powdery or solid block form, in an amount of from 0.05 to 8 wt. %, preferably of from 0.1 to 5 wt. %, more preferred of from 0.3 to 3 wt. % based on the total use solution.

Another object of the present invention is a method of cleaning surfaces which are susceptible to corrosion in alkaline liquids using the above described aqueous concentrate or any of the above described use solutions according to the present invention.

Although the employment of the aqueous cleaning concentrate or the use solutions is not limited to metals which are sensitive to corrosion in alkaline liquids, one main advantage is its use for such sensitive metal surfaces as with the present aqueous cleaning concentrate or the use solutions no corrosion occurs. In particular the aqueous cleaning concentrate or the use solutions according to the present invention are appropriate to be applied for cleaning the surfaces of soft metals like aluminum, tin, zinc, lead or cadmium, of their alloys or of other metals or alloys such as galvanized steel, especially steel plated with any of those metals. The most preferred metal surfaces are made of aluminum, aluminum alloys or zinc plated steel. The main alloy additions for the aluminum alloys preferably represent copper, magnesium, silicon, manganese and zinc.

In a preferred embodiment of the method according to the present invention the surface to be cleaned is at first brought into contact with the aqueous cleaning concentrate or the use solutions according to the invention. Optionally the contacted surface is rinsed and/or dried afterwards. The contact between the aqueous cleaning concentrate or the use solutions and the metal surface can be obtained by the common methods known in the art such as dipping the metal surface into the aqueous cleaning concentrate or the use solutions or directing the aqueous cleaning concentrate or the use solutions onto the surface, for example by spraying or pouring.

The contact time to obtain sufficient cleaning results may range from a few seconds to several hours. Preferably it ranges from 30 seconds to 2 hours, more preferred from 1 minute to 30 minutes. The contact time may be achieved by providing one contact for the whole contact time or by sequentially contacting the metal surface with the aqueous cleaning concentrate or the use solutions for a specific shorter time wherein the contact time corresponds to the sum of each of the shorter contact periods.

The cleaning results may be improved by agitating the aqueous cleaning concentrate or the use solutions during the whole contact time or during a specific period of the total contact time. In some cases it might also be helpful to raise the temperature of the aqueous cleaning concentrate or the use solutions for example to temperatures of from 20 to 90° C., preferably of from 40 to 60° C.

The method of the present invention may for example refer to the cleaning of outer surfaces made of metal of an article, to its inner surfaces or to both outer and inner surfaces. The cleaning method for outer surfaces is supposed to mainly differ from the cleaning method for inner surfaces with respect to the difficulty to reach the corresponding surface. Typically for cleaning outer surfaces the article remains as it is and the cleaning solution is applied onto the surface to be cleaned. When cleaning inner surfaces for example of an article or a machine, it may be necessary to disassemble the corresponding part of the article or the machine which comprises the surface to be cleaned, as the surface may not be reached by the cleaning solution otherwise. This procedure is often referred to as cleaning out of place (COP). Such a procedure preferably is carried out at ambient temperatures (typically room temperature). However, in some cases it might also be appropriate to raise the temperature up to 60° C.

However, a further way to clean difficult to reach inner surfaces of an article or a machine represents circulating the aqueous cleaning concentrate or the use solutions through the article or the machine, provided that, thereby, the surface to be cleaned gets into contact with the aqueous cleaning concentrate or the use solutions. This procedure is often referred to as cleaning in place (CIP). Such a procedure preferably is carried out at the temperature ranges mentioned above. Both ways of cleaning (COP and CIP) are possible when using the aqueous cleaning concentrate or the use solutions according to the present invention.

The cleaning method according to the present invention may proceed manually or automatically. In case the cleaning proceeds automatically the process can be fully or partly automatic.

The method according to the present invention is applicable to institutional as well as to domestic cleaning purposes.

Examples for surfaces which may be cleaned by the method according to the present invention represent window frames, facades, machines such as (automatic) cleaning machines which contain the specified metal surfaces like dishwashers, scrubber-dryers including walk behind scrubber-dryers or ride-on scrubber dryers, packaging machines, production machines or processing machines in all kinds of industrial fields like food and beverage processing machines, machines used in the production and packaging of beauty care compounds, of pharmaceuticals or of consumer goods, instruments and installations in the medical field, tanks, piping systems, filling machines, metal surfaces which can be found in the household such as pots, (frying) pans, decoration accessories, furniture or parts thereof, frames and all kinds of the corresponding surfaces in vehicles like cars, trucks, ships, boats, bicycles or motorcycles.

The invention will be further elucidated by the following examples. All indications of a quantity refer to wt. % unless indicated otherwise.

EXAMPLES

Table 1 presents examples of aqueous concentrates according the present invention (No. 1 to 20) as well as comparative examples (21 to 26) which do not comprise any corrosion inhibitor salt according to the present invention. All compositions were obtained by first dissolving the corrosion inhibitor salt in the specified amount of water and adding the remaining ingredients in the order of their listing in the table. The mixtures were stirred until a homogenous solution was obtained.

TABLE 1

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 |
|---|---|---|---|---|---|---|---|---|---|---|---|---|---|
| Demineralized water | 47.7 | 42.2 | 45.7 | 48.2 | 48.7 | 49.0 | 49.1 | 59.6 | 59.2 | 58.2 | 69.1 | 68.7 | 67.7 |
| Potassium hydroxide (50% aq. sol.) | 8.7 | 8.7 | 8.7 | 8.7 | 8.7 | 8.7 | 8.7 | | | | 8.7 | 8.7 | 8.7 |
| Sodium hydroxide (50% aq. sol.) | | | | | | | | 6.2 | 6.2 | 6.2 | | | |
| Sodium lauryl sulfate (30% aq. sol.) | 8.0 | 3.0 | 3.0 | 8.0 | 8.0 | 8.0 | 8.0 | | | | | | |
| Aminoxide, dimethylcoconutalkyl (30% aq. sol.) | | 10.0 | 10.0 | | | | | | | | 13.0 | 13.0 | 13.0 |
| Phosphonobutane tricarboxyclic acid (50% aq. sol.) | 6.1 | 6.1 | 6.1 | 6.1 | 6.1 | 6.1 | 6.1 | 6.1 | 6.1 | 6.1 | 6.1 | 6.1 | 6.1 |
| Sodium hypochlorite | 25.0 | 25.0 | 25.0 | 25.0 | 25.0 | 25.0 | 25.0 | 25.0 | 25.0 | 25.0 | | | |
| Sodium cumolsulfonate | 3.0 | 3.0 | | 3.0 | 3.0 | 3.0 | 3.0 | 3.0 | 3.0 | 3.0 | 3.0 | 3.0 | 3.0 |
| $MgSO_4 \times 7H_2O$ | | | | | | | | | | | | | |
| $BaCl_2 \times 2H_2O$ | | | | | | | | | | | | | |
| $FeCl_2 \times 4H_2O$ | | | | | | | | | | | | | |
| $MnCl_2 \times 4H_2O$ | | | | | | | | | | | | | |
| $AlCl_3$ | | | | | | | | | | | | | |
| $MgCl_2$ | | | | | | | | | | | | | |
| $CaCl_2$ | 1.5 | 2.0 | 1.5 | 1.0 | 0.5 | 0.2 | 0.1 | 0.1 | 0.5 | 1.5 | 0.1 | 0.5 | 1.5 |
| Σ | 100.0 | 100.0 | 100.0 | 100.0 | 100.0 | 100.0 | 100.0 | 100.0 | 100.0 | 100.0 | 100.0 | 100.0 | 100.0 |

| | Ex. 14 | Ex. 15 | Ex. 16 | Ex. 17 | Ex. 18 | Ex. 19 | Ex. 20 | CE. 1 | CE. 2 | CE. 3 | CE. 4 | CE. 5* | CE. 6* |
|---|---|---|---|---|---|---|---|---|---|---|---|---|---|
| Demineralized water | 84.6 | 81.7 | 83.2 | 46.4 | 47.4 | 45.9 | 45.9 | 49.2 | 59.7 | 69.2 | 82.2 | 46.5 | 46.5 |
| Potassium hydroxide (50%) | | 8.7 | | 8.7 | 8.7 | 8.7 | 8.7 | 8.7 | | 8.7 | 8.7 | 8.7 | 8.7 |
| Sodium hydroxide (50%) | 6.2 | | 6.2 | | | | | | 6.2 | | | | |
| Sodium lauryl sulfate (30%) | | | | 8.0 | 8.0 | 8.0 | 8.0 | 8.0 | | | | 8.0 | 8.0 |
| Aminoxide, dimethylcoconutalkyl (30%) | | | | | | | | | | 13.0 | | | |
| Phosphonobutane tricarbocyclic acid (50%) | 6.1 | 6.1 | 6.1 | 6.1 | 6.1 | 6.1 | 6.1 | 6.1 | 6.1 | 6.1 | 6.1 | 6.1 | 6.1 |
| Sodium hypochlorite | | | | 25.0 | 25.0 | 25.0 | 25.0 | 25.0 | 25.0 | | | 25.0 | 25.0 |
| Sodium cumolsulfonate | 3.0 | 3.0 | 3.0 | 3.0 | 3.0 | 3.0 | 3.0 | 3.0 | 3.0 | 3.0 | 3.0 | 3.0 | 3.0 |
| $MgSO_4 \times 7H_2O$ | | | | | | | 3.3 | | | | | | |
| $BaCl_2 \times 2H_2O$ | | | | | | 3.3 | | | | | | | |
| $FeCl_2 \times 4H_2O$ | | | | | | | | | | | | | 2.7 |
| $MnCl_2 \times 4H_2O$ | | | | | | | | | | | | 2.7 | |
| $AlCl_3$ | | | | | 1.8 | | | | | | | | |
| $MgCl_2$ | | | | 2.8 | | | | | | | | | |
| $CaCl_2$ | 0.1 | 0.5 | 1.5 | | | | | | | | | | |
| Σ | 100 | 100 | 100 | 100 | 100 | 100 | 100 | 100 | 100 | 100 | 100 | 100 | 100 |

*not stable

In table 1 examples 1 to 7 and comparative example 1 represent alkaline foam cleaners also providing active chlorine. Such cleaners may also be used for manual cleaning. The active chlorine therein exhibits disinfecting properties beside cleaning booster properties.

Examples 8 to 10 and comparative example 2 represent alkaline non-foaming cleaners also providing active chlorine. It is possible to add further non-foaming surfactants resistant against active chlorine. The active chlorine therein exhibits disinfecting properties beside cleaning booster properties.

Examples 11 to 13 and comparative example 3 represent alkaline foam cleaners which do not provide active chlorine. Such cleaners can also be used for manual cleaning.

Examples 14 to 16 and comparative example 4 represent non-foaming cleaners which do not provide active chlorine. It is also possible to further add non-foaming surfactants.

Examples 17 to 20 and comparative examples 5 and 6 represent alkaline foam cleaners providing active chlorine differing in the type of corrosion inhibitor salt chosen. Those cleaners can also be used for manual cleaning.

Table 2 shows the material compatibility results using the compositions according to table 1. Only compositions from comparative examples 5 and 6 could not be tested as they were not stable. The compatibility test took place at a temperature of 20° C. Aluminum and galvanized (Zn) steel test plates each of 5×10 cm size were weighed and afterwards completely submerged for one hour into an aqueous solution containing 5% of the single compositions. After that time the test plates were removed from the solutions and weighed again to determine the weight loss. For comparative purposes comparative example 1 is repeated when presenting the results of examples 17 to 20.

TABLE 2

| | CE. 1 | Ex. 1 | Ex. 2 | Ex. 3 | Ex. 4 | Ex. 5 | Ex. 6 | Ex. 7 | CE. 2 | Ex. 8 | Ex. 9 | Ex. 10 |
|---|---|---|---|---|---|---|---|---|---|---|---|---|
| Salt-concentration [mg/l] | — | 750 | 1000 | 750 | 500 | 250 | 100 | 50 | — | 50 | 250 | 750 |
| | Weight loss [g/(m$^2$ × h)] | | | | | | | | | | | |
| Al-plate | 8.77 | 1.04 | 0.05 | 0.99 | 1.85 | 4.28 | 6.31 | 7.38 | 8.77 | 7.25 | 4.28 | 1.00 |
| Steel(Zn)-plate | 0.53 | 0.02 | 0.00 | 0.01 | 0.05 | 0.12 | 0.23 | 0.43 | 0.52 | 0.22 | 0.12 | 0.01 |

| | CE. 3 | Ex. 11 | Ex. 12 | Ex. 13 | CE. 4 | Ex. 14 | Ex. 15 | Ex. 16 | (C1) | Ex. 17 | Ex. 18 | Ex. 19 | Ex. 20 |
|---|---|---|---|---|---|---|---|---|---|---|---|---|---|
| Salt-concentration [mg/l] | — | 50 | 250 | 750 | — | 50 | 250 | 750 | — | 1400 | 900 | 1650 | 1400 |
| | Weight loss [g/(m$^2$ × h)] | | | | | | | | | | | | |
| Al-plate | 8.77 | 7.30 | 4.33 | 1.10 | 8.77 | 7.15 | 4.50 | 1.14 | 8.77 | 1.87 | 1.06 | 2.82 | 1.36 |
| Steel(Zn)-plate | 0.54 | 0.19 | 0.13 | 0.01 | 0.60 | 0.20 | 0.08 | 0.01 | 0.54 | 0.02 | 0.01 | 0.05 | 0.01 |

From the data presented in table 2 it becomes obvious that the weight loss due to corrosion effects caused by the cleaning composition decreases with increasing amounts of the corrosion inhibitor salt according to the present application. The best results were achieved using $CaCl_2$ as corrosion inhibitor salt.

The cleaning properties were tested with some selected compositions. The cleaning properties were determined using aluminum (99.8) plates of 5×10 cm size which were soiled with 1 g tallow each. The test plates were dipped 10 times per minute into the cleaning solution containing 2 wt. % of the corresponding composition in demineralized water. The test was conducted at a solution temperature of 38° C. The results are shown in table 3.

TABLE 3

| | Water | Ex. 1 | Ex. 3 | Ex. 10 | Ex. 13 | Ex. 16 | Ex. 17 | Ex. 18 | Ex. 19 | Ex. 20 |
|---|---|---|---|---|---|---|---|---|---|---|
| Weight soil [g] | 1.0111 | 0.9995 | 1.0389 | 1.0988 | 0.9947 | 1.0027 | 1.0016 | 0.9966 | 1.0051 | 1.0008 |
| Removed soil [%] | 2.17 | 98.08 | 98.95 | 87.82 | 93.14 | 82.06 | 96.48 | 98.80 | 99.02 | 98.72 |
| ASolution appearance of the solution (visual) | Good dispersion | Good dispersion | ok | ok | ok | ok | ok | ok | ok | Partly brown |
| Evaluation* | −− | + | + | ○ | + | ○ | + | + | + | + |

*++ no residues
+ >90% removed
○ 80-90% removed
− 70-80% removed
−− <70% removed The data in table 3 show that the cleaning compositions according to the present invention show in most cases very good cleaning properties on aluminum plates in comparison to a solution only consisting of water.

The invention claimed is:

1. A composition for cleaning surfaces which are susceptible to corrosion in alkaline liquids, comprising, in admixture and contacting one another:

1 to 40 wt. % at least one alkalinity source selected from the group consisting of alkali metal carbonates, alkali metal bicarbonates, and mixtures thereof;

0.01 to 20 wt. % at least one inorganic salt containing at least one cation selected from a group consisting of $Mg^{2+}$, $Ca^{2+}$, $Sr^{2+}$, $Ba^{2+}$, $Al^{3+}$ or mixtures thereof and an anionic counterion to the cation selected from the group comprising halides and sulfate; and 2 to 35 wt. % a phosphonoalkane polycarboxylic acid or its salt as sequestrant;

wherein:

the composition is free of any compound containing silicon, any triazole, any alkali metal borate or combination thereof;

the composition is non-foaming;

the composition is present in the form of a powder or a solid block.

2. The composition according to claim 1, wherein the composition is free of any organometallic compound.

3. The composition according to claim 1, wherein the sequestrant represents the sodium or potassium salt of a phosphonoalkane polycarboxylic acid.

4. The composition according to claim 1, wherein the composition additionally contains one or more surfactants.

5. The composition according to claim 4, wherein the one or more surfactants are selected from anionic and/or nonionic surfactants.

6. The composition according to claim 4, wherein the one or more surfactants are contained in the composition in a total amount of from 1 to 30 wt. % based on the total composition.

7. The composition according to claim 1, wherein the composition additionally contains one or more oxidants.

8. The composition according to claim 7, wherein the oxidants comprise one or more chlorine sources.

9. The composition according to claim 7, wherein the one or more oxidants are contained in the composition in a total amount of from 30 to 80 wt. % based on the total composition.

10. The composition according to claim 1, wherein the composition additionally contains one or more solubilizers.

11. The composition according to claim 10, wherein the one or more solubilizers are contained in the composition in a total amount of from 1 to 35 wt. % based on the total composition.

12. The composition according to claim 1, wherein the composition additionally contains one or more compounds selected from the group comprising disinfectants, builder substances, solvents and bleaching agents.

13. The composition according to claim 1, wherein the inorganic salt contains a cation selected from the group consisting of $Mg^{2+}$, $Sr^{2+}$, $Ba^{2+}$, $Al^{3+}$, and mixtures thereof.

14. The composition according to claim 1, wherein the inorganic salt contains a $Mg^{2+}$ cation.

15. The composition according to claim 1, further comprising ethylene diamine tetraacetic acid.

* * * * *